US006700212B2

(12) United States Patent
Ackermann et al.

(10) Patent No.: US 6,700,212 B2
(45) Date of Patent: Mar. 2, 2004

(54) METHOD FOR CONTROLLING THE STARTING TORQUE AND STARTING POWER OF AN INTERNAL COMBUSTION ENGINE

(75) Inventors: Manfred Ackermann, Oppenweiler (DE); Beqir Pushkolli, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 128 days.

(21) Appl. No.: 10/040,832

(22) Filed: Jan. 8, 2002

(65) Prior Publication Data

US 2002/0124825 A1 Sep. 12, 2002

(30) Foreign Application Priority Data

Jan. 8, 2001 (DE) ..... 101 00 525

(51) Int. Cl.[7] ..... F02N 11/04
(52) U.S. Cl. ..... 290/36 R; 290/40 R
(58) Field of Search ..... 290/38 R, 40 R

(56) References Cited

U.S. PATENT DOCUMENTS 4,295,085 A * 10/1981 Lafuze ..... 318/721
4,780,619 A * 10/1988 Campbell et al. ..... 307/10.1
4,797,602 A 1/1989 West ..... 322/10
5,430,362 A * 7/1995 Carr et al. ..... 318/779
5,594,322 A * 1/1997 Rozman et al. ..... 322/10
6,365,983 B1 * 4/2002 Masberg et al. ..... 290/40 C
6,405,701 B1 * 6/2002 Masberg et al. ..... 123/192.1

FOREIGN PATENT DOCUMENTS

| | | | | |
|---|---|---|---|---|
| DE | 33 43 018 | | 6/1984 | |
| DE | 3608555 | A1 * | 9/1987 | ..... H02P/7/00 |
| DE | 44 21 512 | | 6/1995 | |
| EP | 0 233 738 | | 8/1987 | |
| EP | 0 847 494 | | 6/1998 | |
| FR | 2 563 280 | | 10/1985 | |
| JP | 07123797 | A * | 5/1995 | ..... F02D/29/06 |
| JP | 2000059915 | A * | 2/2000 | ..... B60L/11/14 |
| JP | 2001221139 | A * | 8/2001 | ..... F02N/11/08 |

* cited by examiner

*Primary Examiner*—Joseph Waks
(74) *Attorney, Agent, or Firm*—Kenyon & Kenyon

(57) ABSTRACT

A method for optimizing the starting torque and for reducing the electrical power usage of a starter-generator of an internal combustion engine. The starter-generator is configured as an electrical machine, which is operated using an inverter or an indirect a.c. converter the electrical power $P_{el}$ being made available by a vehicle battery. Before the imaginary turning point (31) on the torque curve (4) of the starter-generator is reached, the phase current of the electrical machine is limited. The electrical machine is controlled from the point at which a limiting point (32) is reached along the electrical limiting power curve (30) (P=const), such that the electrical power $P_{el}$ corresponds to that at the stationary operating point (25) of the electrical machine.

9 Claims, 2 Drawing Sheets

METHOD FOR CONTROLLING THE STARTING TORQUE AND STARTING POWER OF AN INTERNAL COMBUSTION ENGINE

BACKGROUND INFORMATION

Internal combustion engines used in motor vehicles are continually being optimized with respect to exhaust emissions and fuel consumption. One source of avoidable fuel consumption as well as avoidable exhaust gas and noise emissions is urban driving. In urban driving, due to the frequent stopping at traffic lights and intersections, internal combustion engines in motor vehicles spend a not inconsiderable part of their operating time idling. This represents a considerable waste of resources and an environmental burden, because it results in an unnecessary overconsumption of fuel and therefore in an associated emission of poisonous, climate-relevant, and injurious exhaust gases. To rectify these unnecessary idling phases, motor vehicles are equipped with start/stop automatic systems, the internal combustion engine being shut down in the presence of specific stop conditions and being started up once again electrically in the presence of specific start conditions. Using start/stop systems of this type, it is possible to significantly reduce the idling phases of internal combustion engines in urban driving.

Start/stop systems for automatically shutting down internal combustion engines have been made known from European Published Patent Application No. 0 233 738, German Patent No. 33 43 018, and German Patent No. 44 21 512. Although drive systems having start/stop automatic systems have proven their basic suitability for everyday use, they are nevertheless affected by disadvantages. Among the latter are a loud starter noise, which derives essentially from the transmission noises of the pinion gear transmission of the high-gear-ratio starter motor (pinion gear-toothed gear ratio 1:9 through 1:15, auxiliary transmission gear ratio 1:3 through 1:6, overall gear ration 1:30 through 1:60). Due to actuating the starter for the internal combustion engine, which occurs frequently in urban driving, an increased noise disturbance arises for the vehicle occupants as well as for the residents of areas in inner cities near traffic lights and intersections. In addition, components such as electromagnetic switches, pinion gears, meshing devices, as well as electromotors experience enormous wear in response to frequent actuation in urban driving. To limit the wear, in known drive systems, overdimensioned starters are used, which require a great deal of installation space and which, because of their own great weight, negate a portion of the fuel economies achieved by shutting down the internal combustion engine.

French Published Patent Application No. 2 563 280 discloses, in a drive system for a motor vehicle, not to shut down the vehicle internal combustion engine in drive pauses, but rather to continue to have it rotate using an electrical machine, so as to provide auxiliary aggregates with mechanical drive energy. The electrical machine in accordance with this solution also functions as a starter for the internal combustion engine.

U.S. Pat. No. 4,797,602 discloses a starter/generator which operates in conjunction with a start-stop control system. The starter/generator has a gear ratio with respect to the internal combustion engine of 4:1. The starter/generator runs on a voltage that is increased in comparison to an automobile electrical system, an energy storage unit being provided at the increased voltage level.

European Patent No. 0 847 494 relates to a drive system, in particular, for a motor vehicle, as well as to an operating method. The proposed drive system includes an internal combustion engine as the drive aggregate, and also an electrical polyphase machine, that is directly coupled to a drive shaft of the drive aggregate, or is capable of being so coupled. The polyphase machine rotates at the identical speed of the drive shaft, and it is configured so that it can start as a drive aggregate, starting from a standing position. At least one inverter is provided, which generates for the magnetic fields of the electrical machine voltages and/or currents of variable frequency, amplitude, and/or phase. The inverter has an intermediate circuit having a voltage level that is elevated with respect to the electrical system of the motor vehicle, provision being made in this electrical system for an energy storage device for storing electrical energy. In addition, a further energy storage device is provided, from which energy is taken for starting, and which is an electrical energy storage device at the elevated voltage level of the intermediate circuit and/or an electrically operated flywheel storage unit electrically connected in parallel via the intermediate circuit to an intermediate-circuit capacitor at the elevated voltage level. In addition an automatic start/stop control unit is provided, in the context of which the drive aggregate is started using the electrical machine.

SUMMARY OF THE INVENTION

The advantage to be achieved through the method proposed in accordance with the present invention is to be seen above all in the fact that among the boundary conditions for achieving a reliable starting function in a cold start and for achieving a rapid, as far as possible noiseless warm start, the electrical power to be generated by the vehicle battery can be reduced up to 20%. The electrical machine used as the starter/generator, which can be operated on an inverter or on an indirect a.c. converter, is limited before reaching an imaginary turning point, i.e., before the intersection of the characteristic curve for the mechanical power of the starter-generator and the starting torque characteristic curve, by limiting the phase current of the electrical machine. As a result of the limiting, it is achieved that the electrical power that can be made available by the vehicle battery does not at any time point exceed electrical power $P_{el}$ required at the stationary operating point. In this way, it is achieved that the energy storage unit can be optimally adjusted to electrical power $P_{el}$ of the starter-generator in the latter's stationary operating point.

The prompt limiting of the electrical machine at a limiting point and operating it at an electrical limiting power curve determined as a function of the status parameters of a motor vehicle battery prevents an electrical machine functioning as the starter-generator from operating at an imaginary operating point, at which a far greater electrical power $P_{el}$ is necessary, in comparison with electrical power $P_{el}$ actually required in the stationary operating point of the electrical machine. Abandoning the torque curve of the starter-generator and operating the latter along the electrical limiting power curve yield a reduction in the starting torque in a narrow rotational speed range of the internal combustion engine. Above a rotational speed of roughly 50 $min^{-1}$, the starting torque is below the value at the stationary operating point and always above the torque requirement, so that the starting function of the internal combustion engine is assured even in cold-start conditions.

One improvement of the cold start function, or a power reduction, can be achieved in coordination with the thermal design of the inverter of the electrical machine, by setting an elevated torque below the electrical limiting power curve, at small rotational speeds.

The control/regulation of the power limiting of the electrical machine is accomplished as a result of the fact that the maximum electrical battery power is taken from a measurement of the battery terminal voltage in conjunction with a limiting value regulation of the phase current at the voltage lower limit. The obtained maximum electrical battery power determines the electrical limiting power curve and the position of the limiting point on the torque curve of the starter-generator.

If a claw pole generator is used as the starter-generator, then the phase current on it can be reduced when a predetermined rotational speed is reached. A different possibility for the power limitation of a claw pole generator having an indirect a.c. converter lies in influencing the angle (load angle) between the phase voltage and the phase current space vectors when a predetermined rotational speed of the internal combustion engine is reached.

DETAILED DESCRIPTION

Figure 1:
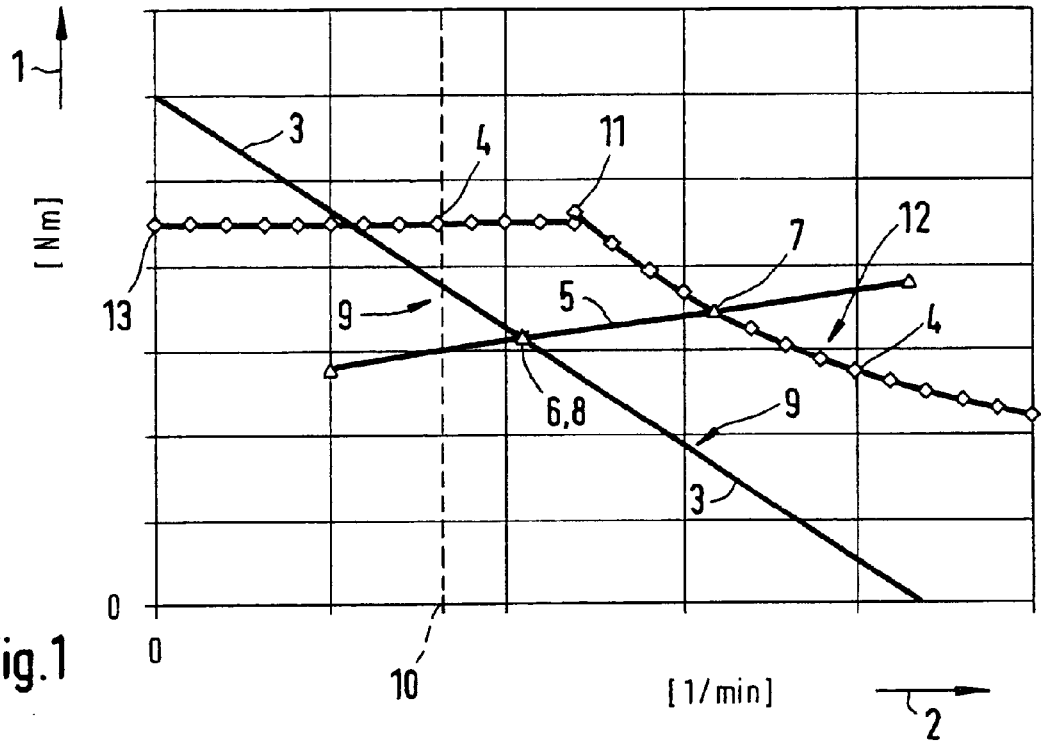
FIG. 1 depicts a diagram in which the curves of the starting torques of a conventional starter and of a starter-generator are plotted over the rotational speed.

The representation in FIG. 1 depicts a diagram in which the starting torque curves of a conventional starter are contrasted with those of a starter-generator, plotted over rotational speed.

The diagram in FIG. 1 depicts starting torque curve 3 of a conventional starter, plotted over rotational speed 2. The characteristic curve of starting torque curve 3 is designated by a linear curve 9 and depicts a linear decrease of the starting torque at an increasing rotational speed 2. Power maximum 8 of the conventional starter coincides with the position of operating point 6, at which load curve 5 of an internal combustion engine intersects characteristic curve 3 of the starting torque curve. In the diagram according to FIG. 1, load curve 5 represents characteristic curve 3 of the internal combustion engine having 3 l displacement and 6 cylinders.

Reference numeral 4 indicates the starting torque curve of a starter-generator, the curve beginning from an operating point 13 (n=0) and delivering a constant torque up to a turning point 11. After turning point 11, the starter-generator is set at a constant mechanical output $P_{mech}$ of roughly 3 KW. Operating point 7 of the starter-generator is defined as the intersection of starting torque curve 4 with load curve 5 of the internal combustion engine. Compared with operating point 5 of a conventional starter, operating point 7 of the starter-generator is at a higher rotational speed 2, because the obviously lower starting inertial torque of the starter-generator requires an increased average rotational speed 10. In this way, an increased maximum rotational speed 10 can be realized, which, similar to the value of the conventional starter, lies above a minimum rotational speed, so that the requirements for a cold-start capability are met. Minimum rotational speed 10 is in the range of roughly 80 $min^{-1}$. In contrast to operating point 5 of the conventional starter, at operating point 7 of the starter-generator there is an increased load torque 1. This is caused by increased frictional torque as well as by the speed shift amplitude present at a higher rotational speed, at which amplitude increased wall heat losses and leakage losses arise in the internal combustion engine.

Figure 2:
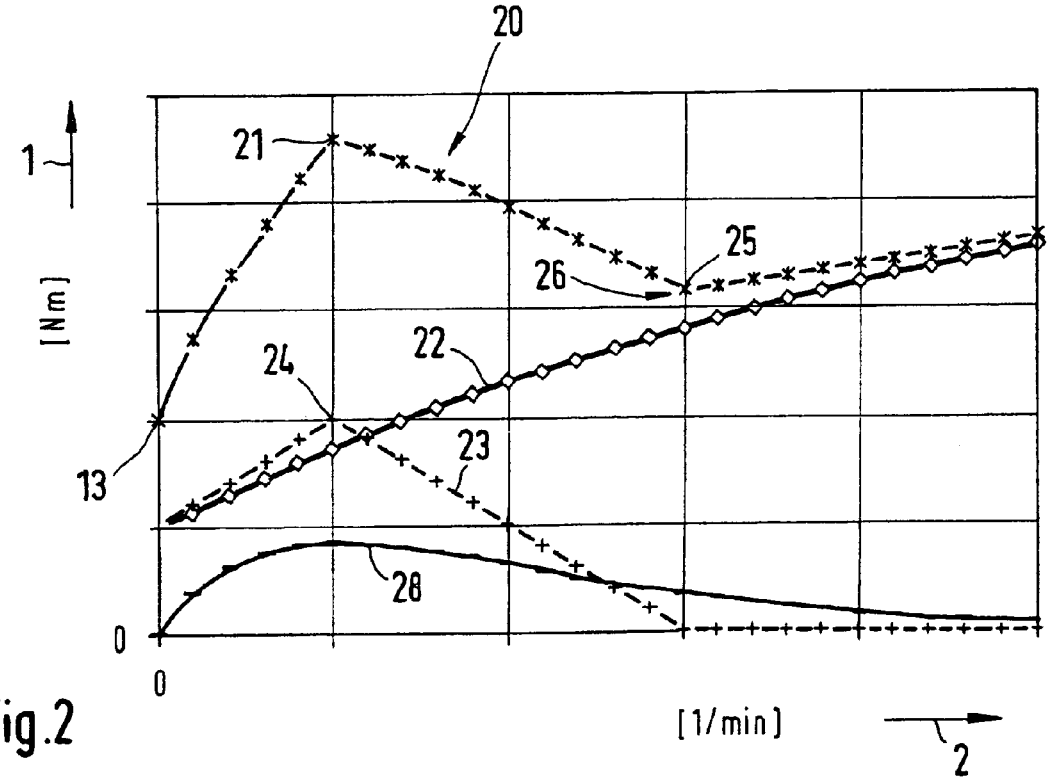
FIG. 2 depicts the torque loss components to be covered by the starting torque to be generated, such as compression losses, friction, and acceleration torque components.

FIG. 2 depicts the torque requirement in a starter-generator as a function of the rotational speed curve.

The diagram according to FIG. 2 illustrates curve 20 of the starting torque, which is generated when the internal combustion engine is started by the starter-generator. The starting torque to be produced by the starter-generator, in addition to a frictional torque 22, also covers torque components that derive from acceleration torques and pneumatic spring torques due to the differing mixture volumetric efficiencies of the individual cylinders of an internal combustion engine. Depending on the number of cylinders of the internal combustion engine to be started, these torque components can be subject to fluctuations, which are produced by the starting torque of the starter-generator. In internal combustion engines having smaller numbers of cylinders, the smaller inertial torque and the missing compensation of the compression torques, as a result of the decompression torques of the cylinder pistons moving from the upper dead center to the lower dead center, lead to an increase in these torque components. In internal combustion engines having a greater number of cylinders, high compression loss torques arise.

If, however, the starter-generator, in rotating the crankshaft of the internal combustion engine, reaches a quasi-stationary operating point, then acceleration torque components as well as pneumatic spring torque components drop out; on the other hand, the frictional torque components increase due to the increased rotational speed.

The starting torque to be produced by the starter-generator runs in accordance with curve 20, proceeding from rotational speed 2 n=0. The curves of torque losses 22, 23 and compression losses 28 are represented as a function of rising rotational speed 2 of the internal combustion engine. Torque components 22, 23 and compression losses 28 of the internal combustion engine are a function of the starting system of an internal combustion engine, whether it is an SI (spark ignition) engine or diesel engine. Torque components 22, 23 and compression losses 28 are also a function of leakage or wall heat losses, which arise in the cylinder/piston arrangements of the internal combustion engine.

A maximum 21 of the starting torque arises at a rotational speed 2 of the internal combustion engine of roughly 50 $min^{-1}$. At this rotational speed 2, there are already high compression pressures, but on the other hand the compression losses reach their maximum at maximum 21 of torque 20 to be generated.

Reference numeral 22 designates the curve of the frictional torque over rotational speed 2. The frictional torque is essentially proportional to the total displacement of the internal combustion engine. In the diesel engine, the frictional torques are fundamentally roughly 30% higher than in the case of comparable SI engines, which has its cause in the higher compression pressure level arising in the diesel engine and the piston rings/cylinder wall fit having narrower tolerances.

The curve of the acceleration torque is indicated as reference numeral 23, in startup point 13, i.e., at n=0, a sufficiently high torque is available for rotating the crankshaft of the internal combustion engine. At maximum 24, the rotational acceleration torque requirement reaches its maximum value, because the pneumatic spring torques, as a result of the mixture to be compressed in the cylinders of the internal combustion engine, already reach 70% of their maximum value, at a rotational speed 2 of the internal combustion engine of roughly 50 $min^{-1}$.

However, at this low rotational speed 2 of the internal combustion engine, sufficient reserves in rotational energy of the internal combustion engine are not yet available. Beyond maximum 24, acceleration torque 23 to be generated decreases in linear fashion, whereas the frictional torque, corresponding to its curve 23, continually increases as rotational speed 2 increases.

Curve 20 of the starting torque to be generated by starter-generator results from the superimposition of torque components 22, 23 and compression losses 28. According to the curve path designated by reference numeral 20 in FIG. 2, a characteristic torque requirement profile results, which is characterized by a maximum 21 at a rotational speed 2 of roughly 50 $min^{-1}$ and at a relative minimum in the range between 120 and 180 $min^{-1}$. A further criterion for the torque requirement according to torque curve 20 in FIG. 1 is the circumstance that at every time point the starting torque to be generated by the starter-generator is to lie above quasi-stationary drag torque 27. According to the parameters of an internal combustion engine, such as inertial torque and number of cylinders, the starting torque is to be designed so that the "upper dead center" rotational speed for the starting capability of an internal combustion engine can be reached even under unfavorable conditions, i.e., in a cold start.

Figure 3:
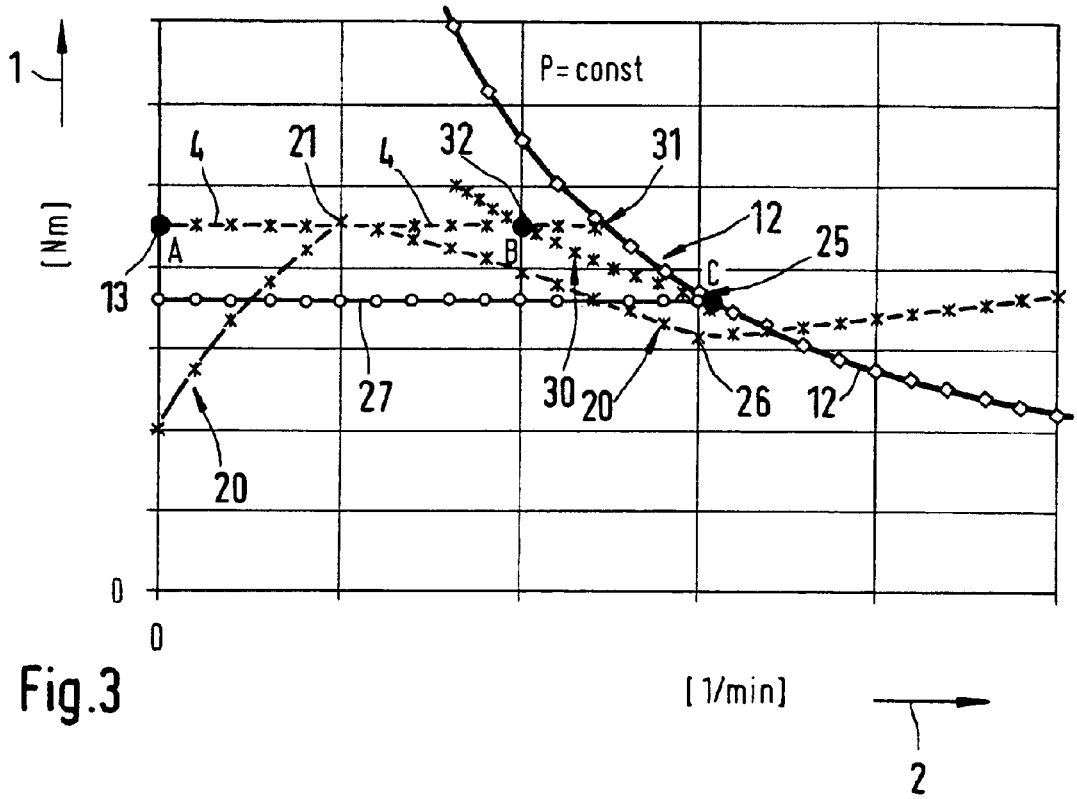
FIG. 3 depicts an exemplary design of a crankshaft starter-generator having minimized electrical power consumption in the stationary operating point.

From the representation in FIG. 3, an exemplary design of a crankshaft starter-generator is depicted having minimized electrical power usage.

From startup point 13, i.e., a rotational speed n=0 of the internal combustion engine, starting torque curve 4 of the starter-generator runs at a constant level until an imaginary turning point. At imaginary turning point 31 of starting torque curve 4 of the starter-generator, the mechanical output reaches a constant value, which corresponds to characteristic curve segment 12 for P=const in the diagram according to FIG. 3. The torque requirement placed on the electrical machine functioning as the starter-generator runs in accordance with curve path 20 according to the representation in FIG. 2. Torque 20 to be generated can be determined from a superimposition of torque components 22, 23 described in FIG. 2 and compression losses 28, it being important to take into consideration whether the internal combustion engine to be started up is an SI engine or a diesel engine; in addition, in determining the torque requirement of the starter-generator, the number of cylinders is of decisive importance.

The value of the drag torque identified as reference numeral 27, which lies below the starting torque to be generated by the starter-generator, would not assure that the OT rotational speed of the internal combustion engine would be reached under unfavorable conditions.

Reference numeral 30 in the representation of the diagram in FIG. 3 depicts the electrical limiting power curve. The latter can be determined from the maximum electrical battery power by a measurement of the battery terminal voltage in conjunction with a threshold value regulation of the phase current at the voltage lower limit of the electrical machine functioning as the starter-generator. Electrical limiting power curve 30 intersects the characteristic curve of starting torque curve 4 as well as characteristic curve 27 of the drag torque. At intersection 32 of starting torque curve 4 and electrical limiting curve 30 lies the limiting point, which occurs before imaginary turning point 31, at which the starter-generator requires greater electrical power. If the starter-generator at limiting point 32 is controlled in accordance with electrical limiting curve 30, then it reaches its stationary operating point 25, which in the design example depicted in FIG. 3 is at a rotational speed of roughly n=150 $min^{-1}$. In stationary operating point 25, the starter-generator accepts electrical power $P_{el}$ that can be made available in accordance with electrical limiting power curve 30, which never becomes greater than that at the stationary operating point 25 of the starter-generator. In this manner, it is assured that the energy storage unit used in the motor vehicle is only to be designed for the electrical power consumption in stationary operating point 25 of the starter-generator, and no oversizing of the energy storage unit arises. At stationary operating point 25, it is assured that torque 4 to be generated by the starter-generator clearly still lies above the curve of the drag torque identified using reference numeral 27. Thus, on the one hand, an optimal operation of a starter-generator with respect to electrical power $P_{el}$ utilized and the starting torque to be generated is achieved within a starting system for an internal combustion engine.

The starting torque effective at stationary operating point 25 is only smaller than the starting torque in a very narrow rotational speed range, and it lies in a rotational speed range of n>50 $min^{-1}$ above the torque requirement represented by curve path 20, so that the starting function remains assured. To improve the cold-start function of the starter-generator, i.e., for power reduction, it is possible, at small rotational speeds, in cooperation with the thermal design of the inverter used by the motor functioning as the starter-generator, to set an elevated torque below electrical limiting power curve 30. This elevated torque is available as a reserve in the cold start to assure a reliable start of the internal combustion engine even below the design temperatures (−25° C.).

If a claw pole generator is used as the starter-generator, which is operated using an indirect a.c. converter, then the power limitation at limiting point 32 is realized as follows. The maximum preestablished setpoint phase current in a claw pole generator can be reduced starting at a preestablished rotational speed, for example, rotational speed 2 present at limiting point 32. On the other hand, it is possible to realize a power limitation of the claw pole generator as a result of the fact that the angle (load angle) between the phase voltage and phase current space vectors is influenced beginning at a preestablished rotational speed 2 at the limiting point 32. The torque produced by the claw pole generator is a function of this angle. The electrical limiting power curve 30 can also be determined under the influence of a power reserve, so that the function of other components and assemblies in the electrical system of a motor vehicle remains assured, and a power reserve measured as a function of the loads of the electrical system can be made available. In this context, the decisive points are assuring the start function in the cold start as well as realizing a rapid, noiseless warm start of the internal combustion engine using the starter-generator optimized according to the present invention.

List of Reference Numerals

1 torque curve
2 rotational speed
3 starting torque curve of conventional starter
4 starting torque curve of starter-generator
5 load curve of an internal combustion engine

6 operating point of conventional starters
7 operating point of starter-generator
8 power maximum
9 linear curve
10 average rotational speed
11 turning point
12 characteristic curve segment of starter-generator (P=const)
13 start-up point (n=0)
20 torque to be generated by starter-generator
21 torque maximum (50 $min^{-1}$)
22 frictional torque curve
23 acceleration torque curve
24 maximum (50 $min^{-1}$)
25 stationary operating point of starter-generator (150 $min^{-1}$)
26 relative minimum (120 to 180 $min^{-1}$)
27 drag torque value in Thab A.P.
28 compression losses
30 electrical limiting power curve
31 imaginary turning point
32 limiting point of starter-generator

What is claimed is:

1. A method for optimizing a starting torque and for reducing an electrical power usage of a starter-generator for an internal combustion engine, the starter-generator being configured as an electrical machine that is operated in accordance with an inverter, the method comprising the steps of:

causing a battery to generate an electrical power;

limiting a phase current of the electrical machine for reaching an imaginary turning point on a torque characteristic curve of the electrical machine; and controlling the electrical machine beginning at a limiting point along an electrical limiting power curve such that the electrical power corresponds to that at a stationary operating point of the electrical machine.

2. The method according to claim 1, wherein:

the starter-generator includes a claw pole generator that is operated using an indirect a.c. converter.

3. The method according to claim 2, wherein:

a power limiting of the claw pole generator operated in the indirect a.c. converter takes place at the limiting point beginning with an internal combustion engine rotational speed corresponding to the limiting point, by reducing a setpoint phase current of the claw pole generator.

4. The method according to claim 2, wherein:

an angle between a phase voltage space vector and a phase current space vector is influenced beginning with a preestablished internal combustion engine rotational speed corresponding to the limiting point.

5. The method according to claim 1, further comprising the step of:

obtaining the electrical limiting power curve by measuring a voltage of battery terminals and by measuring a limiting value regulation of the phase current at a voltage lower limit.

6. The method according to claim 5, wherein:

at the limiting point a limiting of the electrical power of the starter-generator occurs along the electrical limiting power curve at $P_{el}$=const, so that $P_{el} \leqq P_{el}$ at the stationary operating point is always satisfied.

7. The method according to claim 1, wherein:

in order to improve a cold-start function in the inverter assigned to the electrical machine, an increased starting torque can be set for the electrical machine.

8. The method according to claim 1, further comprising the step of:

storing a maximum electrical limiting power and a minimum battery voltage curve corresponding to the maximum electrical limiting power as a temperature-dependent characteristic curve relationship.

9. The method according to claim 1, wherein:

at the stationary operating point, an electrical efficiency of the electrical machine, instead of an efficiency at the imaginary turning point of the torque characteristic curve, determines a maximum battery output.

* * * * *

UNITED STATES PATENT AND TRADEMARK OFFICE

CERTIFICATE OF CORRECTION

PATENT NO. : 6,700,212 B2 
DATED : March 2, 2004
INVENTOR(S) : Manfred Ackermann et al.

It is certified that error appears in the above-identified patent and that said Letters Patent is hereby corrected as shown below:

Column 7,
Lines 15 - 16, change "(150 min $^{-}{}_{1}$)" to -- (150 min $^{-1}$) --.

Signed and Sealed this

Twenty-ninth Day of March, 2005

JON W. DUDAS
*Director of the United States Patent and Trademark Office*